United States Patent [19]

Hatala

[11] Patent Number: 4,475,256

[45] Date of Patent: Oct. 9, 1984

[54] SHOWER TRANSFER BENCH

[75] Inventor: John Hatala, Clifton, N.J.

[73] Assignee: Temco Home Health Care Products, Inc., Passaic, N.J.

[21] Appl. No.: 477,158

[22] Filed: Mar. 21, 1983

[51] Int. Cl.[3] ..... A61H 33/02; A47K 3/00; A47K 3/02; A47K 3/022

[52] U.S. Cl. ..... 4/562; 4/559; 4/571; 4/573; 4/579; 248/503.1; 248/225.31; 248/231.2; 297/252; 297/440

[58] Field of Search ..... 4/559–565, 4/571, 573, 578, 579, 611; 248/500, 503.1; 297/252, 440

[56] References Cited

U.S. PATENT DOCUMENTS

| | | | |
|---|---|---|---|
| 2,465,026 | 3/1949 | Martz | 297/252 |
| 2,843,348 | 7/1958 | Samuels | 297/252 |
| 4,253,203 | 3/1981 | Thomas | 4/559 |
| 4,359,791 | 11/1982 | Thomas | 4/559 |
| 4,391,006 | 7/1983 | Smith | 4/559 |

OTHER PUBLICATIONS

Certicare product—Exhibit A of applicant.

*Primary Examiner*—Henry K. Artis

*Attorney, Agent, or Firm*—Richard C. Woodbridge

[57] ABSTRACT

A shower bench apparatus includes a positively engagable non-tipping chair and an easily operable clamping mechanism for attaching the apparatus to the side of a bathtub. The seat of the chair includes a pair of front hook-like brackets for engaging a first rail of the bench and a pair of craddle-like brackets near the rear of said seat for engaging the second rail of the bench. Locking screws are used to positively attach the rear craddling brackets to the second rail. It is virtually impossible to tip the chair over backwards due to the positive engagement of the front hook brackets. The chair may be reversed 180° and repositioned with a minimum of effort. The device is readily clampable to the edge of a bathtub by means of a clamping mechanism driven by a single, easily manipulatable knob.

13 Claims, 11 Drawing Figures

*Fig. 2c.*
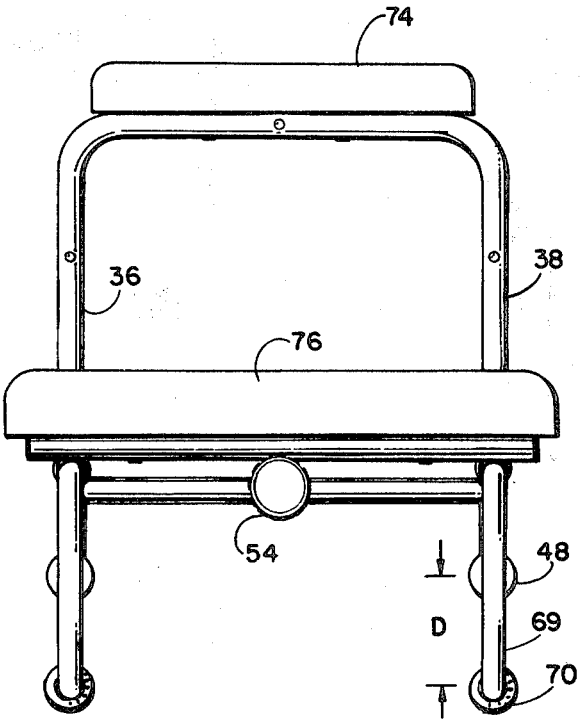
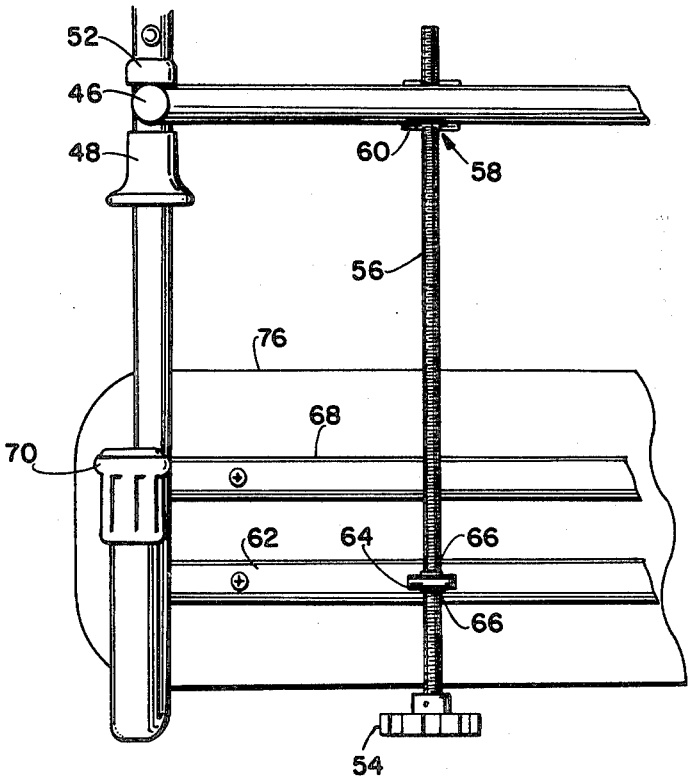
*Fig. 2d.*

SHOWER TRANSFER BENCH

BACKGROUND OF THE INVENTION

1. Field of the Invention

The invention relates to a shower bench for use by people having physical infirmities.

2. Description of the Prior Art

The use of benches or chairs in a shower stall is known in the prior art. For example, Temco Healthcare Industries, Inc., 125 South Street, Passaic, N.J., manufactures a bathtub transfer bench, Model 1995 which comprises a horizontal platform supported by two pairs of legs. One pair of legs sits inside the bathtub and the other pair of legs sits outside the bathtub so that the bench seat straddles the edge of the bathtub. Temco Healthcare Industries, Inc. also produces shower chairs such as models 1979, 1984 and 1985. Chairs may also be produced with or without backs such as in models 1994 and 1996. Seating devices for showers are produced by other manufacturers as well.

One of the more advanced shower benches is described in U.S. Pat. Nos. 4,253,203 and 4,359,791. The inventor in both patents is Morton I. Thomas. U.S. Pat. No. 4,253,203 discloses a folding transfer bench which allows a patient to transfer from the exterior of a bathtub to the interior of a bathtub on a sliding chair. The chair is mounted on rollers which roll across a pair of parallel tracks from the outside to the inside of the bathtub and vice versa. U.S. Pat. No. 4,359,791 discloses an advanced version of the device disclosed in U.S. Pat. No. 4,253,203. Both patents relate to the Temco Healthcare Industries Product Model 1999 known as the "Bio-Care TM Bathtub Transfer Bench".

One of the major problems associated with prior art shower benches is the tendency for the equipment to tip if improperly used. It is especially important that the chair portion of the bench be extremely stabile and strong. It is likely that a patient might put a lot of weight on the back of the chair and, due to a combination of leverage and weight, cause the chair to separate from the rail and tip over. Therefore a clear need was identified to increase the stability of the chair portion of the shower bench without sacrificing ease of use.

Similarly, it is highly desirable to stabilize the bench with respect of the bathtub. This can be accomplished by clamping one end of the transfer bench to the edge of the tub. However, this extra bit of manipulation may be difficult for invalids especially those who have arthritis or other debilitating manual diseases. Therefore another need was identified which required the attaching of a transfer bench to the edge of a bathtub in the simplest, easiest yet safest possible fashion. It was in the context of the foregoing prior art and identification of needs that the present invention arose.

SUMMARY OF THE INVENTION

Briefly described the invention comprises a shower bench that is exceptionally stabile, yet relatively easy to use. The bench comprises a pair of rails supported at one end by the edge of the bathtub and at the other end by a pair of legs. A sturdy clamping mechanism secures the pair of rails to the edge of the bathtub. The clamping mechanism is controlled by a single, easily manipulatable knob which urges a movable jaw on the inside of the bathtub towards a pair of non-movable feet on the outside of the bathtub thereby clamping the edge of the bathtub between the two.

A chair is attachable to the bench by hooking a pair of front hook-like brackets to one rail and seating a pair of rear saddle-like brackets to the other rail. The back brackets are locked in position by means of a threaded bolt or stud. The front brackets are mounted horizontally so as to hook the first rail. This automatically sets the distance so that the second set of rear brackets engage the other rail. The rear brackets are mounted vertically so as to form an upside down "U" which straddles the other rail. Once the chair is in position it is virtually impossible to knock it over since the front hook brackets positively engage the front rail.

The invention is further superior to known shower benches in that it is easy to install and use.

These and other aspects of the invention will be more fully understood with reference to the following drawings.

BRIEF DESCRIPTION OF THE DRAWINGS

FIG. 2*c* is an end view of the clamping section of the bench.

FIG. 2*d* is a detailed view of the clamping mechanism.

DETAILED DESCRIPTION OF THE INVENTION

During the course of this description like numbers will be used to identify like elements that appear in different figures which illustrate the invention.

Figure 1A:
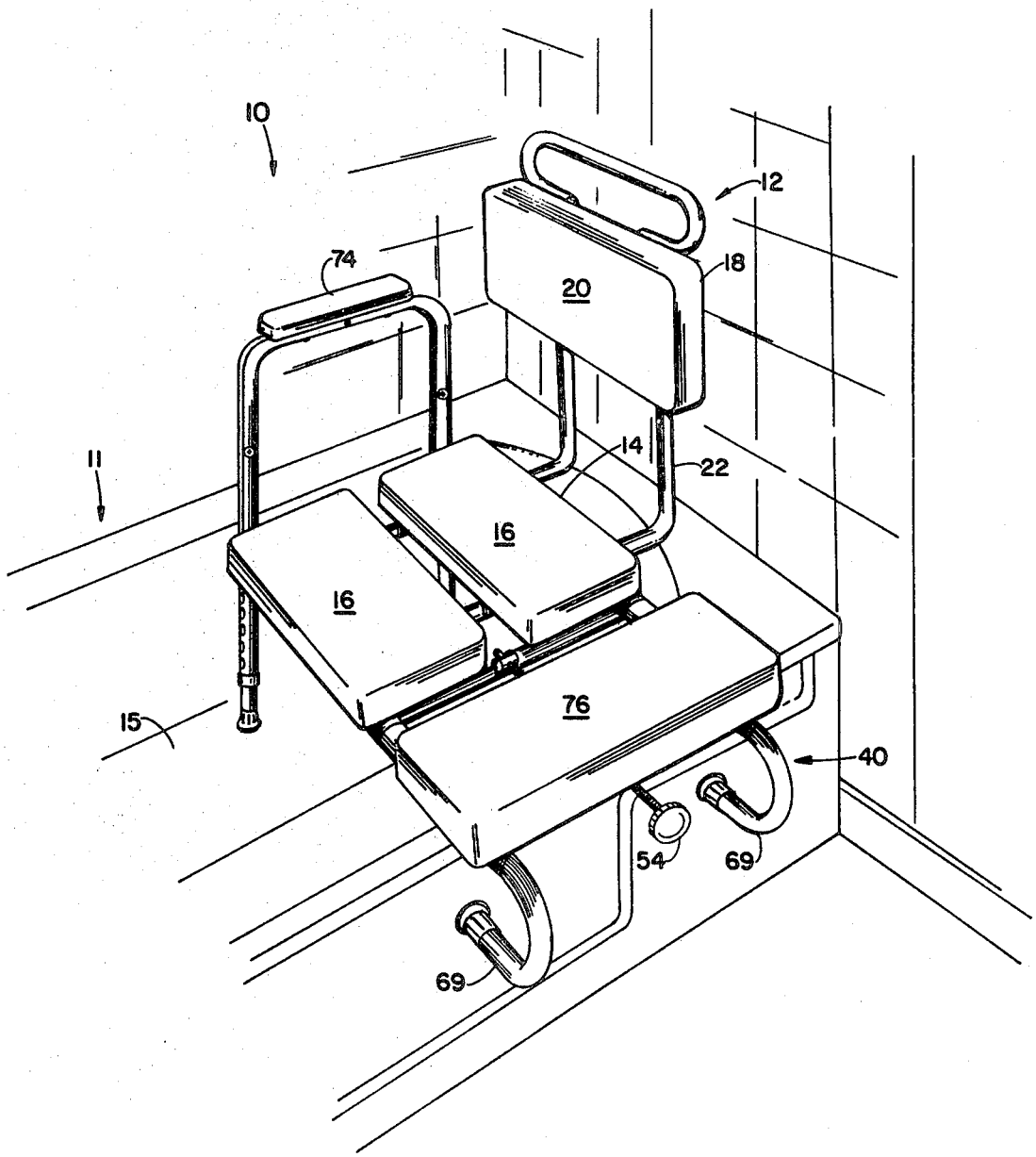
FIG. 1*a* is a front perspective view of the invention with the chair in place.
Figure 1B:
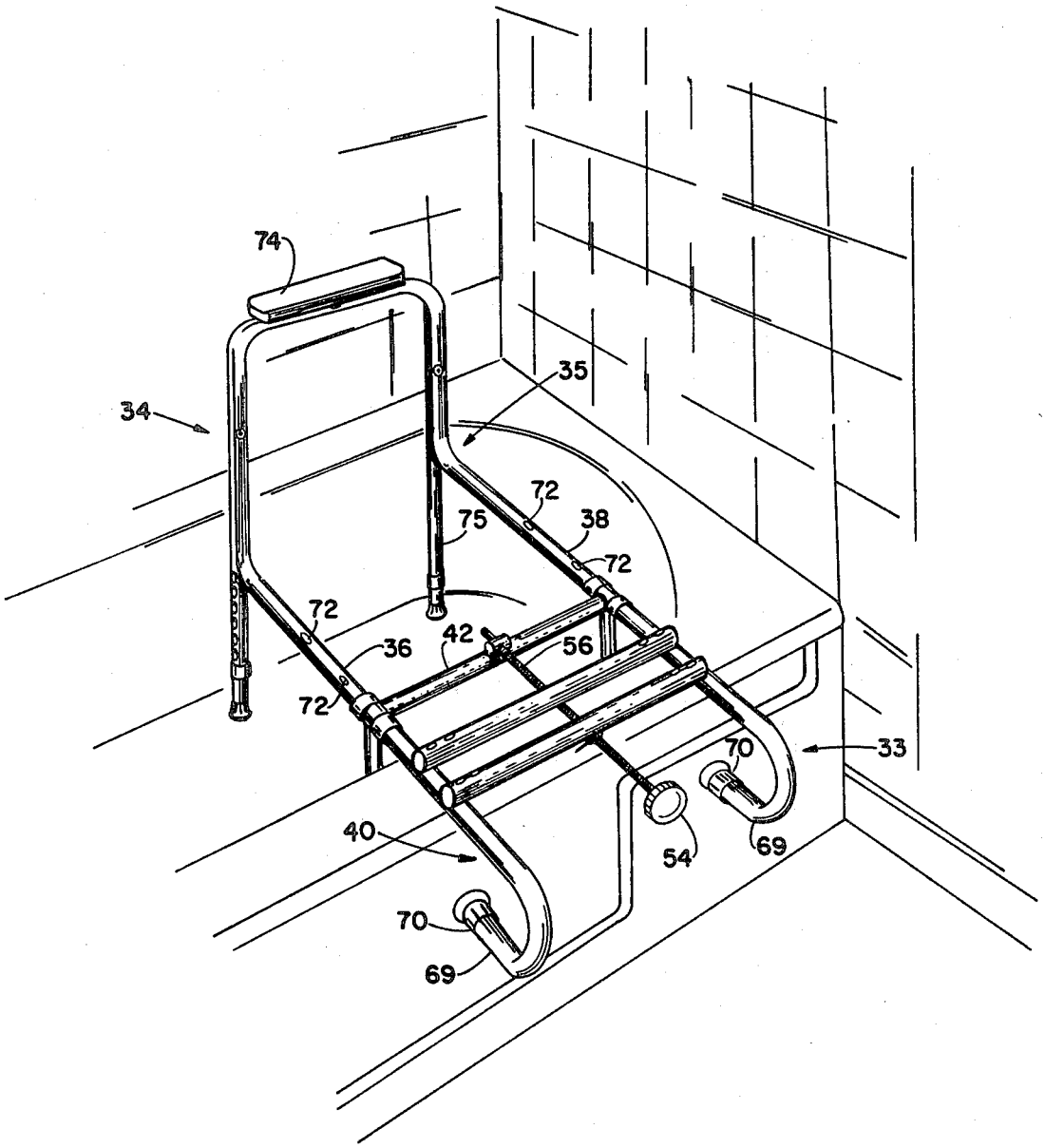
FIG. 1*b* is a front perspective view of the invention with the chair and all pads removed showing the manner in which the bench is attached to the edge of a conventional bathtub.
Figure 2A:
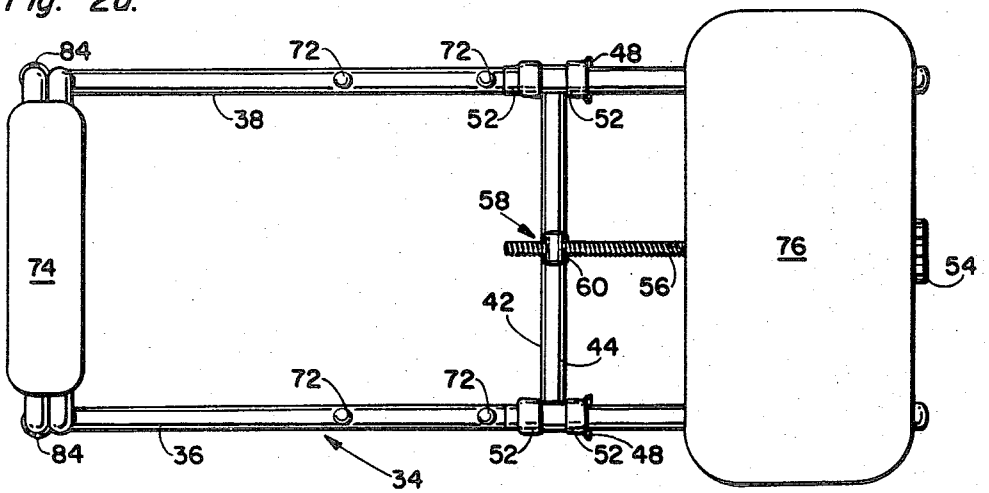
FIG. 2*a* is a top plan view of the bench without the chair.
Figure 2B:
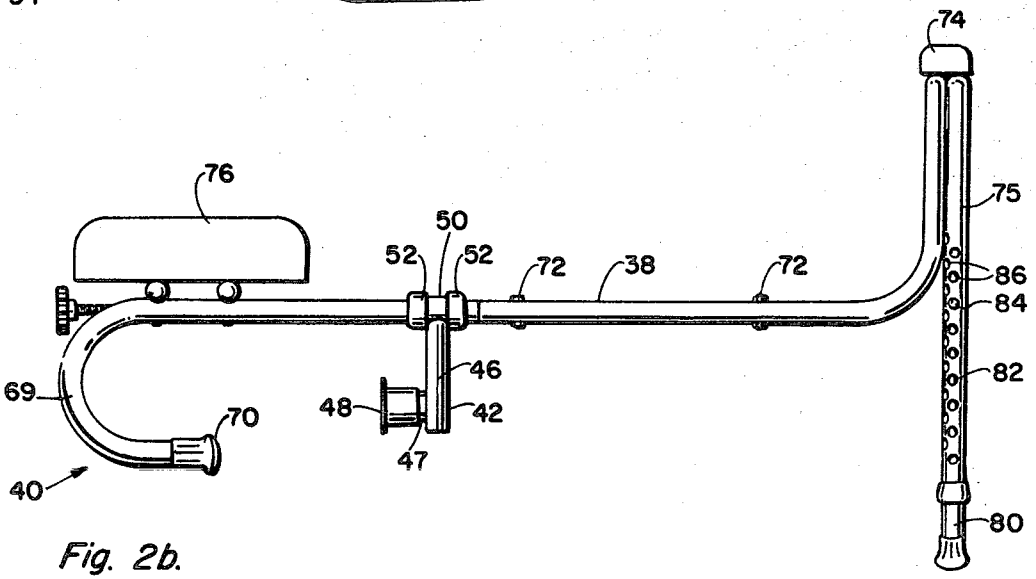
FIG. 2*b* is a side elevational view of the bench without the chair.

The invention 10 is shown in perspective view in FIG. 1. The apparatus is typically mounted in a bathtub 11 in the manner shown. The invention 10 essentially comprises a chair 12 mounted on a rail bench unit 34. The details of the bench unit 34 are shown in FIGS. 2*a*–2*d* where the chair 12 has been removed from the invention 10.

Details of the chair 12 can be more fully understood by reference to FIGS. 3*a* through 3*e*. Chair unit 12 comprises a seat section 14, a back section 18, and a chair frame 22 connecting the seat 14 and back 18 together. Two seat pads 16 are attached to seat section 14. Similarly a back pad 20 is connected across the back section 18. Screws 24 are used to attach pads 16 and 20 to frame 22.

Figure 3A:
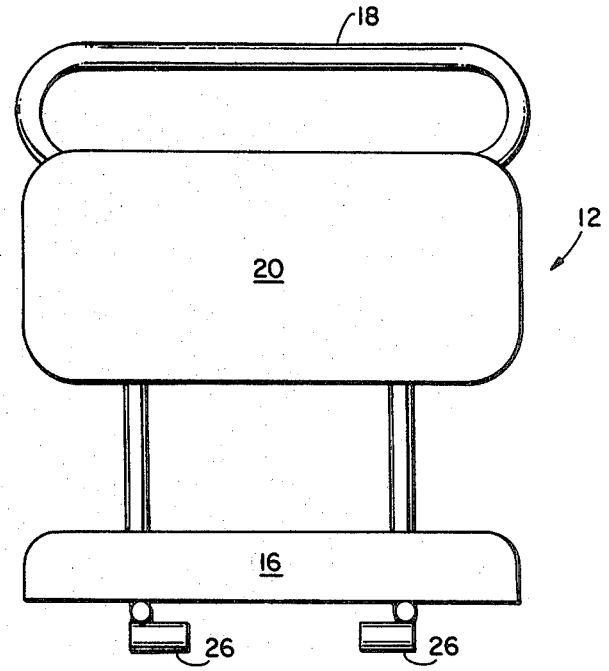
FIG. 3*a* is a front elevational view of the chair unit alone.
Figure 3B:
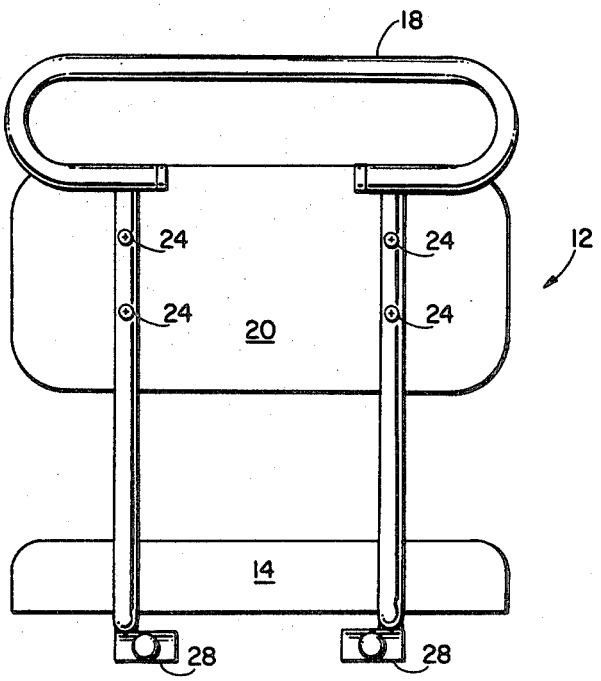
FIG. 3*b* is a back elevational view of the chair element unit alone.
Figure 3C:
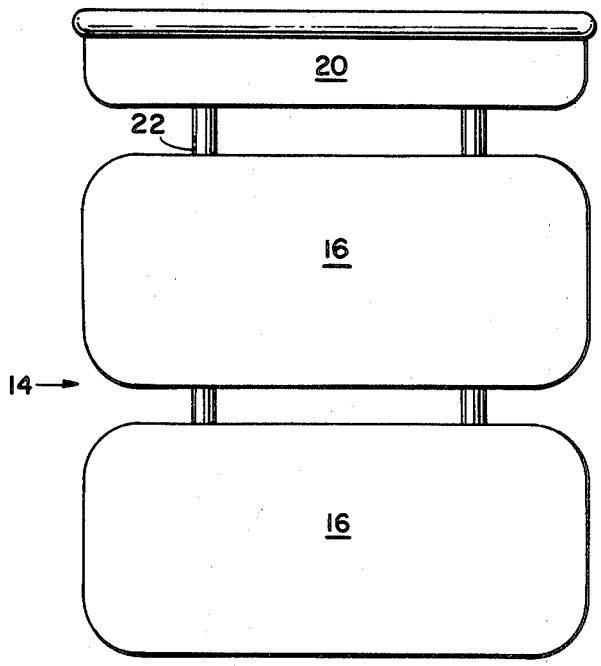
FIG. 3*c* is a top plan view of the chair unit alone.
Figure 3D:
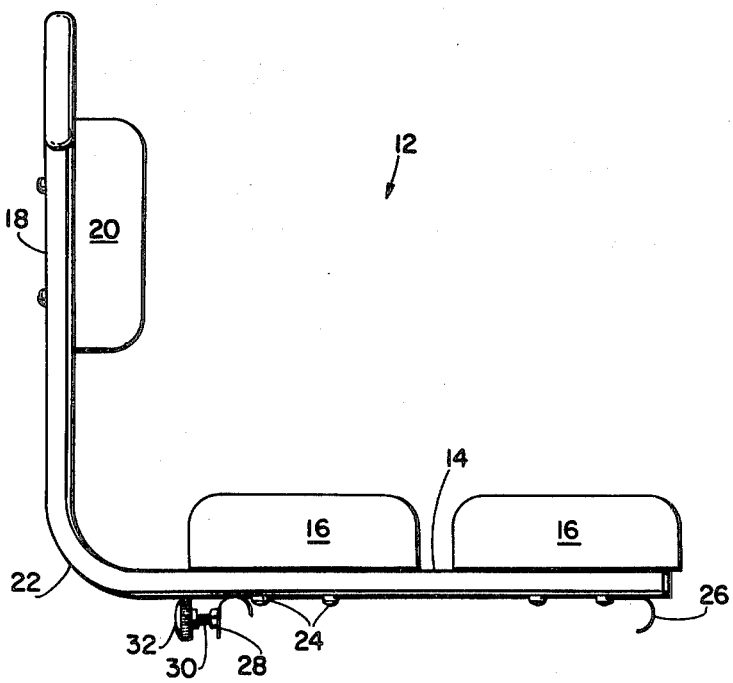
FIG. 3*d* is a side elevational view of the chair unit alone.
Figure 3E:
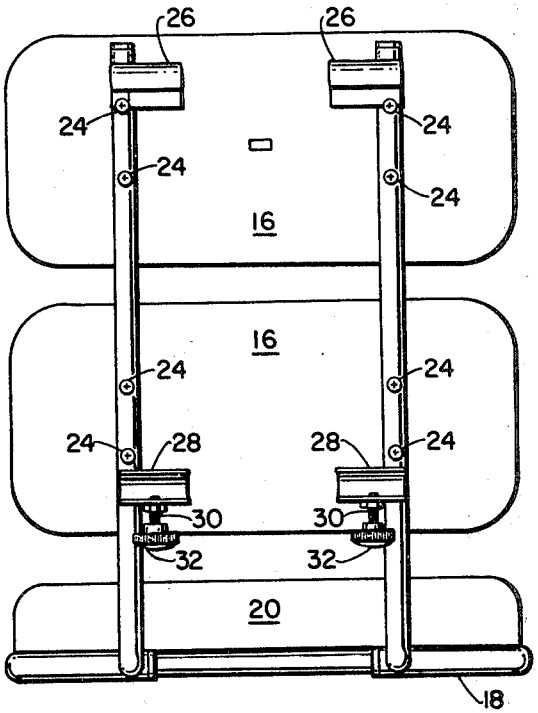
FIG. 3*e* is a bottom view of the chair unit alone.

Two pairs of brackets 26 and 28 are attached to the underside of chair 12 as shown in detail in FIG. 3*e*. Brackets 26 and 28 are made from 13 gauge (0.089") ¼ hard steel 1⅞" wide. The brackets are formed with a 0.505" to 0.507" radius with one leg being longer than the other. A 5/16" hole appears in the longer leg. Brackets 26 and 28 are brazed onto the bottom of the steel seat frame 22 in such a way as to become a rigid locking unit with respect to the rail bench unit 34. The front brackets 26 are mounted horizontally so as to snuggly hook onto the first rail 36 of bench 34. Front brackets 26 absolutely prevent backward tipping movement. Rear brackets 28 are mounted vertically attached to the 5/6" hole to the rear and with a ¼"—20 nut brazed or welded to the long leg of the bracket 28. A ¼"—20×¾" long threaded stud 30 passes through the nut. A knob 32 is attached to the threaded stud 30 and needs to be tightened only lightly in order to lock the chair unit 12 to the bench 34. The locking is easily accomplished because the screw is located below the center of the second rail 38 and therefore gives positive interference to upward movement.

The chair frame 22 is preferably made from ⅞"×0.049" steel welded tubing. It is bent and brazed to exact dimensions so that it can be easily removed or reversed as needed. The bench unit 34 is preferably made from 1"×0.049" wall annodized aluminum tubing with ⅞"×0.049" wall aluminum tubing inside the 1" tubing for added strenght and stability.

Lateral movement of the seat unit 12 is prevented by rivets 72 and washers placed on rails 36 and 38 and placed at predetermined locations so that the front brackets 26 just fit on either side of them. In this manner the brackets 26 straddle rivets 72 thereby substantially limiting the horizontal travel of the chair unit 12. Rivets 72 also serve to fasten the interior and exterior tubular elements of the bench unit 34 rigidly together.

Bench unit 34 is securely attached to the tub wall 15 of the shower by means of a clamping mechanism 40. Clamping mechanism 40 incorporates a sliding tubular section 42 which includes a nylon follower nut 58 centered on a transverse following cross brace 44. Extending below each sliding side of cross brace 44 are two ⅞" tubes which form downward depending legs at 90° angles with respect to following cross brace 44. Another section 47 is welded to downwardly depending legs 46 and at 90° thereto and are adapted to accept a rubber tip or foot 48. The rubber suction feet 48 are locate a distance "D" of approximately 2" above the rubber feet 70 located on the outer section of the bench. (See FIG. 2*c*). The 2" displacement has the tendency to rotate the bench unit 34 thereby placing downward force on the rear legs 75. Movable cross brace 44 is attached to rails 36 and 38 by means of sliding sleeves 50. Sliding sleeves 50 comprise 1⅛" tubing which surround the 1" aluminum rail tubes 36 and 38. The Nylon® caps or bushings 52 are attached at opposite ends of the sleeves 50 and facilitate the sliding of the movable section 42 of the clamping mechanism 40.

Nylon follower nut 58 is captured in a housing 60 attached to the transverse following cross brace 44. Nylon® nut 58 is tapped with a ⅜"-16 hole and is loosely fitted in the ⅞" by 1" long tubular housing 60 which is brazed to the top of the cross brace 44. The loose fit allows for the play necessary to avoid binding.

At the front end of the unit is a ⅞"×0.049" steel transverse mounting bar 62 having a 3/16"×1"×1" tab 64 brazed to the center thereof and projecting downwardly towards the bottom of the bench unit 34. Tab 64 includes a 13/32 hole in the center through which a ⅜"16×13" threaded rod is inserted. Threaded rod 56 includes a ⅞" O.D. washer brazed approximately 3" away from one end and a 2" diameter plastic knob 54 attached to the same end. A second washer is located on the opposite side to tab 64 from the first washer. A 3/32" hole is drilled 5/16" beyond the first washer to receive a cotter pin to stop the first washer from moving. The two washers 66 allow the rod 56 to rotate freely in the hole but not to move in a back or forth direction.

The bench unit 34 includes an outside of the tub section 33 and an inside of the tub section 35. The outside section 33 of the transfer bench unit 34 is structurally reinforced by transverse bar 68. A pair of C-shaped legs 69 act as extensions of rails 36 and 38. Rubber feet 70 cap the C-shaped legs 69 in the manner previously described. Rails 36 and 38 telescope onto or over the C-shaped leg sections 69 thereby increasing the effective wall thickness of the rails and improving the strength and rigidity of the bench unit 34. Covered pad 76 is primarily used as an initial seat when a patient first sits on the unit.

The inside of the bathtub section 35 of transfer bench unit 34 includes a pair of legs 75. Legs 75 include an interior section 80 which telescopes into an exterior section 82 connected to the frame so that the legs 75 can extend or collapse according to the depth of the bathtub. The specific telescoping mechanism of the inside legs 75 and the locking buttons 84 and locking holes 86 associated therewith are believed to be known to those of ordinary skill in the art. An elbow pad 74 covers the top of legs 75 and provides comfortable support for the patient using the invention 10.

The invention just described has several major advantages. First of all, the chair unit 12 is extra stabile. From hook brackets 26 and rear brackets 28 make it virtually impossible to tip the chair 12 backward or forward. Secondly, clamping mechanism 40 positively engages bathtub wall 15 thereby guaranteeing the ultimate stability of the bench 34 and chair unit 12 as a whole. Thirdly, the reinforced design of the rails 36 and 38 adds to the stability and rigidity of the unit 10. Fourthly, it is relatively easy for a patient to install and use the invention. The device requires no special tools, skill, dexterity or strength. An arthritic patient can clamp section 40 to the edge of a bathtub 15 using just one hand. Similarly, the chair unit 12 can be easily and securely attached to the bench unit 34 by means of brackets 26 and 28 and locking screw 30 and knob 32.

The invention has been described with reference to the preferred embodiment thereof. A number of modifications would, however, be possible within the inventive concept. For example, clamp knob 54 could be replaced by a crank or similar object. Also, the drive mechanism of the clamping section 40 could be changed. For example, the threaded rod 56 and knob 54 combination might be replaced by a "lazy tong" scissors mechanism or other type of device. Morever, changes can be made to the materials used or to the dimensions described and still stay within the inventive concept.

While the invention has been described with reference to the preferred embodiments thereof, it will be appreciated by those of ordinary skill in the art that other changes can be made to the device without departing from the spirit and scope of the invention.

I claim:

1. In a shower bench apparatus, including a bench having at least two feet and a first and a second rail attached to said feed and a chair unit attachable to said rails, the improvement comprising:

stationary hook bracket means rigidly attached to the underside of said chair unit for selective engagement with one of said bench rails;

stationary cradling bracket means rigidly attached to the underside of said chair unit for selective engagement with the other bench rail; and, locking means attached to said cradling bracket means for selectively locking said chair unit with respect to at least one of said rails, said locking means comprising a threaded means locatable below the center of said rail when said chair unit is engaged with said rail for selectively occupying space in said cradling bracket means thereby preventing said rail from escaping from said cradling bracket means.

2. The bench apparatus of claim 1 wherein said chair unit comprises:

a chair frame;

a seat means attached to said frame; and, a back means attached to said frame.

3. The bench apparatus of claim 2 wherein said hook bracket means is attached to the underside of said seat means and near the front edge thereof and said cradling bracket means is attached to the rear portion of said seat means.

4. The bench apparatus of claim 3 wherein said hook bracket means comprise at least two hook-like brackets.

5. The bench apparatus of claim 4 wherein said cradling bracket means comprise at least two cradle-like U-shaped brackets.

6. The bench apparatus of claim 5 further including:

guide means attached to said rail means for positioning said hook-like brackets and said chair unit relative to said rails.

7. In a shower bench apparatus for use in a bathtub said apparatus including a bench having at least two feet and a first and a second rail attached to said feed and a chair unit attachable to said rails, the improvement comprising:

a slidable section including a cross-brace means for sliding on said first and second rails;

sleeve means attached to said cross-brace means and surrounding said rails;

depending means attached to said cross-brace means;

resilient means attached to said depending means for engagement with the inside wall of said bathtub;

hand operable means connected to said slidable section for driving said slidable section along said rails; and, a stationary section forming a part of said bench which normally lies outside of said bathtub, wherein manipulation of said hand-operable means urges said slidable section towards and away from said stationary section thereby clamping and unclamping said bench with respect to the edge of said bathtub.

8. The shower bench apparatus of claim 7 wherein said hand-operable means includes:

a handle means;

a threaded means attached to said handle means;

a bracket means attached to said stationary section for supporting said threaded means; and, a following means for attaching said threaded means to said cross-brace means.

9. The shower bench apparatus of claim 8 wherein said threaded means is attached to said cross-brace means by a Nylon® plug means loosely connected to said cross-brace means in a housing means.

10. The shower bench apparatus of claim 9 wherein said stationary section comprises:

a "C"-shaped leg means attached to said rails and locatable outside of said bathtub; and, rubber feet means connected to said "C"-shaped leg means for engagement with the outside wall of said bathtub.

11. The shower bench apparatus of claim 10 wherein said rubber feet means attached to said "C"-shaped leg means and locatable on the outside of said bathtub are located approximately 2" below said resilient means connected to said slidable section and locatable on the inside of said bathtub, whereby the clamping of said appartus causes said shower bench apparatus to rotate and put pressure down on the two feet of said shower bench.

12. The shower bench apparatus of claim 11 wherein said two feet are adjustable in length.

13. The shower bench apparatus of claim 12 wherein said handle means comprises a knob.

* * * * *